United States Patent [19]

Wilson, Sr.

[11] 4,263,477

[45] Apr. 21, 1981

[54] ELECTRIC FENCE INSULATOR

[75] Inventor: Robert M. Wilson, Sr., Battle Creek, Mich.

[73] Assignee: Dare Products, Inc., Battle Creek, Mich.

[21] Appl. No.: 107,362

[22] Filed: Dec. 26, 1979

[51] Int. Cl.[3] ..... H01B 17/16; H01B 17/24

[52] U.S. Cl. ..... 174/158 F; 174/166 R; 174/173; 174/175; D13/17

[58] Field of Search ..... 174/158 R, 158 F, 161 F, 174/163 R, 163 F, 164, 165, 166 R, 173, 174, 175; 24/115 J, 115 K; 114/218; 248/65; 256/10; D13/17, 18

[56] References Cited

U.S. PATENT DOCUMENTS

| | | | |
|---|---|---|---|
| D. 248,850 | 8/1978 | Berg, Jr. et al. | 174/158 F X |
| 660,271 | 10/1900 | Henderson et al. | 174/174 |
| 1,169,246 | 1/1916 | Folstad | 174/166 R X |
| 3,572,639 | 3/1971 | Shettel | 174/158 F X |
| 3,749,819 | 7/1973 | Wilson | 174/158 F |

FOREIGN PATENT DOCUMENTS

| | | | |
|---|---|---|---|
| 818209 | 10/1951 | Fed. Rep. of Germany | 174/175 |
| 730593 | 5/1932 | France | 174/175 |

*Primary Examiner*—Laramie E. Askin

*Attorney, Agent, or Firm*—Fisher, Gerhardt, Crampton & Groh

[57] ABSTRACT

An electric insulator for guiding and supporting an electric fence wire. The insulator comprises an elongated body of electrical insulating material and has a mounting means located at one end of the body for mounting the body upon a fence post in an outwardly projecting manner. An upright abutment member is fixed on the opposite end of said body and carries retainer tab means. The tab means project from said abutment in a direction generally toward the mounting means.

6 Claims, 6 Drawing Figures

Fig-1
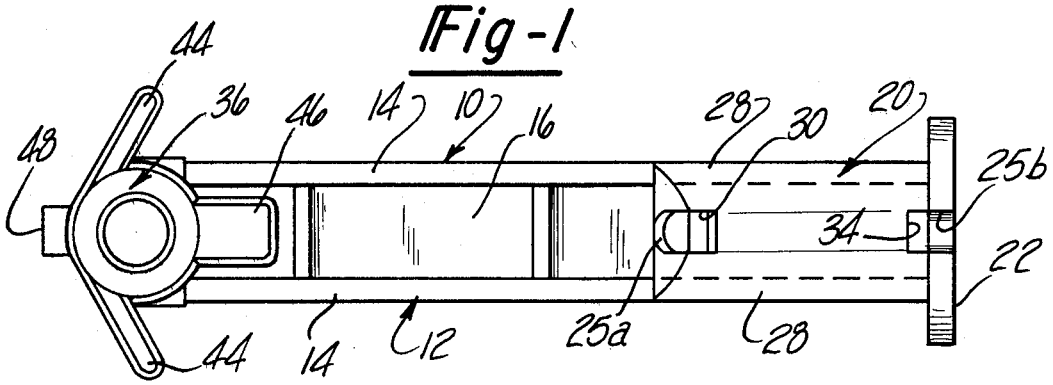
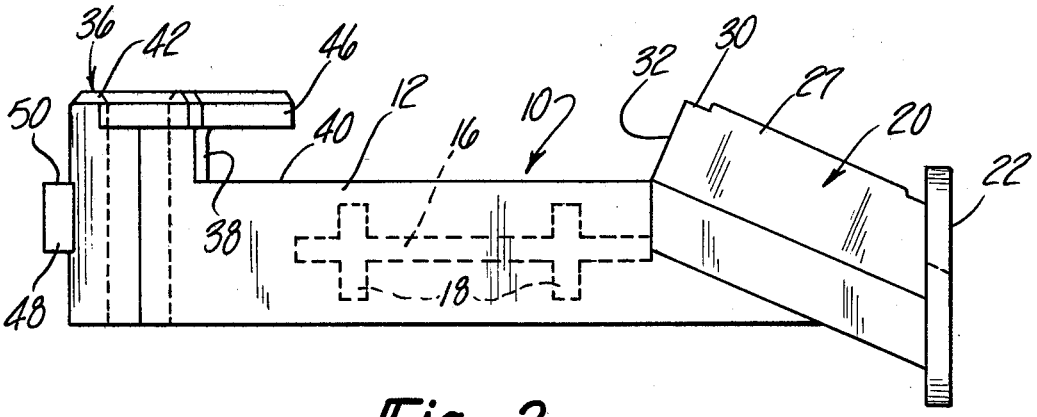
Fig-2
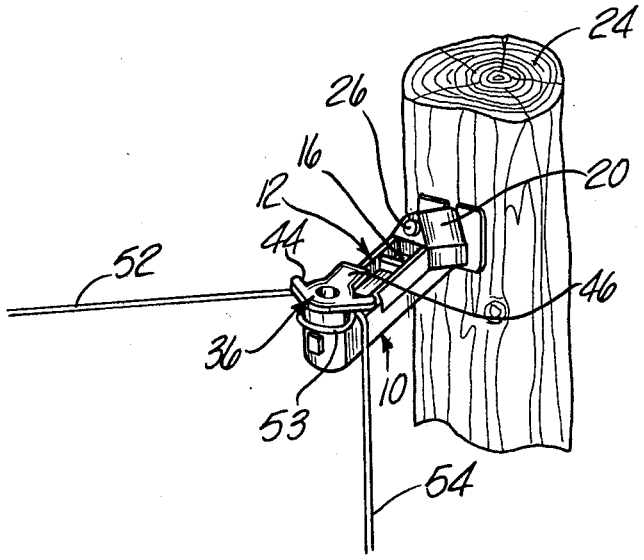
Fig-3

ELECTRIC FENCE INSULATOR

In one aspect, this invention applies to insulators adapted for holding an electric wire in a spaced relationship with respect to fence posts. This invention especially relates to insulators adapted to be used on the corner posts of electrical fences.

The prior art has disclosed rigid mounting devices attached to line posts for holding an electrified wire to form an electric fence. However, such devices have not been usable at the corners. Instead, it has been common practice to form a ring of insulating material having a generally oval shape and to attach one end of the oval insulator to a fence post by means of a loop of wire. The resulting anchored oval is then strung with electrical wire by passing the free end of the wire through the oval and the remainder of the wire to be strung drawn through the oval. Such a process is obviously time consuming and results in a mount wherein the wire is not rigidly positioned. This allows the wire to sag and the wire is difficult to tension since the insulating member is not firmly fixed in space.

In general it is an object of this invention to provide a wire supporting insulating device which is easily attached to the corner pole of a fence and which is adapted to support a current carrying wire. The device should be easily mounted to a post, particularly wooden posts, not require threading to use, and when mounted will preferably provide a fixed support point about which the wire can be tensioned.

The above and other objects are achieved by the electric fence insulator for guiding and supporting an electric fence wire of this invention. The insulator comprises an elongated body of dielectric or electrical insulating material. The elongated body has a mounting means at one end of said body for mounting the body to a fence post so the body projects outwardly from the post. An abutment means having tabs thereon is fixed on the other end of said body with the tabs projecting in a direction generally toward the end of the body attached to the post. The tabs will be vertically spaced from and generally parallel to the upper surface of the elongated body.

An insulator of this structure allows a wire strand to be placed about the abutment and beneath the tabs without uncoiling the remaining wire and the wire can be pulled tight. The slack in the wire already strung can slide past the abutment member as the remaining wire is pulled. As a further feature of the invention, the elongated body maintains the electrified wire a marked distance away from any anchoring means thereby maintaining a substantial arcing distance between the electrified wire and any post or mounting means which may be electrically conductive.

In the accompanying drawings:

FIG. 1 is a top view of one embodiment of the insulator of this invention;

FIG. 2 is a side view of the insulator of FIG. 1;

FIG. 3 is a perspective view of the insulator of FIG. 1 positioned on a wooden corner post with a wire in place;

Figure 4:
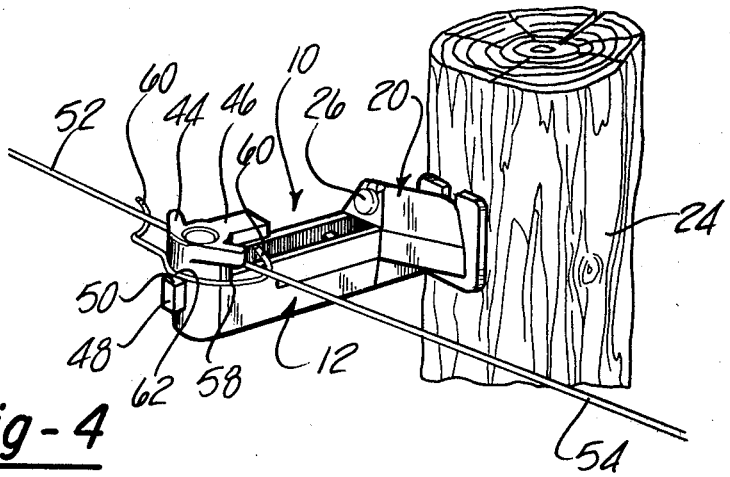
FIG. 4 is a perspective view of an insulator of FIG. 1 shown in position on a line post.

Referring to the accompanying drawing in which like reference numerals denote like parts and more specifically to FIGS. 1 and 2, an electric fence insulator 10 is shown having an elongated body portion 12 formed of an insulating material such as linear polyethylene. As shown, the elongated body 12 comprises two spaced parallel walls 14 with a center reinforcing web 16 connecting the walls. There are two transverse ribs 18 on the top and bottom of the web 16 which cooperate with the web to form a rigid body.

As shown the elongated body 12 has a mounting or attachment means 20 located on one end thereof. The mounting means 20 has a relatively broad flat abutment face 22 for contact with the post to which the insulator 10 is attached. Insulator attachment to a wooden type fence post will be described first.

The insulator 10 is attached to a wooden pole 24 such as in FIG. 3 by means of a nail 26 which extends at an acute angle to the longitudinal axis of the insulator body 12. The nail 26 extends through apertures 25*a*, 25*b* located at each end of a nail retaining portion 27 and nests in a groove at the interior top of the nail retaining portion formed by the retaining portions side walls 28. Thus the nail 24 is in contact with the mounting means 20 along a substantial portion of its length as it passes through the attachment. The substantial contact area provided between the spike and nail retaining portion 27, enables the insulator to resist the twisting forces normally encountered by insulators of this type.

As shown most clearly in FIG. 2, there is a small cutout 30 in the angled or inclined face 32 of the nail retaining portion 27 of the mounting means 20. The small cutout 30 allows a tool to be inserted behind the nail head to pry the nail from the post into which it has been driven. This allows reuse or repositioning of the insulator without damage.

An upright abutment means or upright 36 is located on the end of the body 12 opposite or distal the attachment means 20. As shown, the upright 36 is a nominally cylindrical member which has its axis perpendicular to the longitudinal axis of the body 12 and has a portion 38 extending beyond the plane defined by the upper surfaces 40 of the side member 14 of the elongated body 12. At the free end 42 of the upright 36, located above the body two wing tabs 44 project outward from the upright 36. The tabs 44 have axes which form an acute angle with the axis of the body 12 and have their free ends pointing generally towards the mounting means 20. The wing tabs 44 are attached near the end of the upright furthest from the mounting means 20. As shown, a single large abutment tab 46 is positioned with its axis parallel to the longitudinal axis of the elongated body.

The various tabs 44, 46 are spaced from and lie in a plane nominally parallel to the plane defined by the upper surface of the elongated body 12. As is apparent, a wire can be easily positioned between the tabs and the upper surface 40.

The upright 36 has a small step 48 projecting from the end of the upright opposite the elongated body 12. The upper surface 50 of the step 48 is substantially coplaner with the upper surfaces 40 of the elongated body 12. When a wire is looped about the upright 36 the step 48 will assist in holding the loop of wire in the plane between the tabs 44, 46 and the upper surface of the elongated body.

FIG. 3 shows the insulator 10 positioned on the wooden post 24 by means of the nail 26. As shown wire 52 from a line post (outside the view of the drawings) has been brought to the insulator and a loop 53 of wire formed about the upright 36 with the free end 54 of the wire proceeding from the upright at an angle of approximately 90° to the incoming strand. The figure shows the loop 53 resting on the upper surface 50 of the step and the upper surfaces 40 of the elongated body. The loop 53 is prevented from moving more than a small amount in the vertical direction by the tabs which are extending outward from the upper portion of the upright. Because the insulator 10 is securely anchored to the wooden post 24 by means of the nail 26, the incoming wire 52 can be pulled relatively tight and the free end firmly wrapped around the upright 36 to maintain the tension in the incoming strand allowing the fence installer to tension the incoming wire at the corner before proceeding with installing the fence.

Occasionally the person installing the fence may desire to use one of the insulators as part of a line fence where the wire does not make a 90° angle or indeed may desire to use the insulators shown by this figure throughout the fence due to their configuration. The insulator 10 places the wire at a desirable distance away from the post to prevent shorts and would allow grass and other materials growing underneath the wire to be cut without having the cutter strike the post. As shown in FIG. 4, the incoming wire 52 passes by the innermost surface of the upright 36 where it attaches to the elongated body 12 and underneath the large square tab 46. The wire 52 can then be held in place by means of a metal clip 58 which has its free ends 60 hooked about the wire 52 and the clip's mid-portion 62 is adapted to engage the front surface of the upright 36. The clip 58 is shown resting on the step 48 and the clip is held in place by the step's upper surface 50.

Of course, the insulating device of this invention could not be nailed to metal posts which are sometimes used in electrified fences. In such a case it is common to attach the insulators to the post by means of a wire looped through an aperture in the insulator and then around the metal post. Such an installation technique can be used with the insulator of this invention the wire replacing the nail and passing through the nail retaining portion 27.

Figure 5:
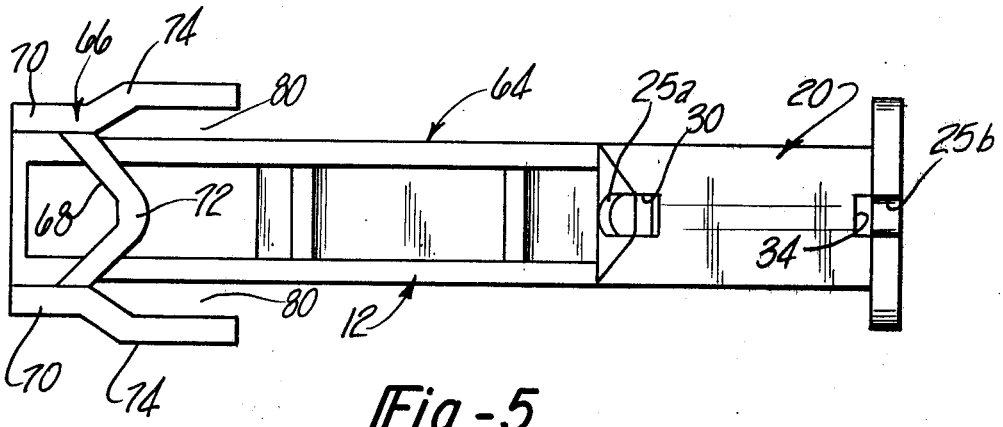
FIG. 5 is a top view of a further embodiment of this invention.
Figure 6:
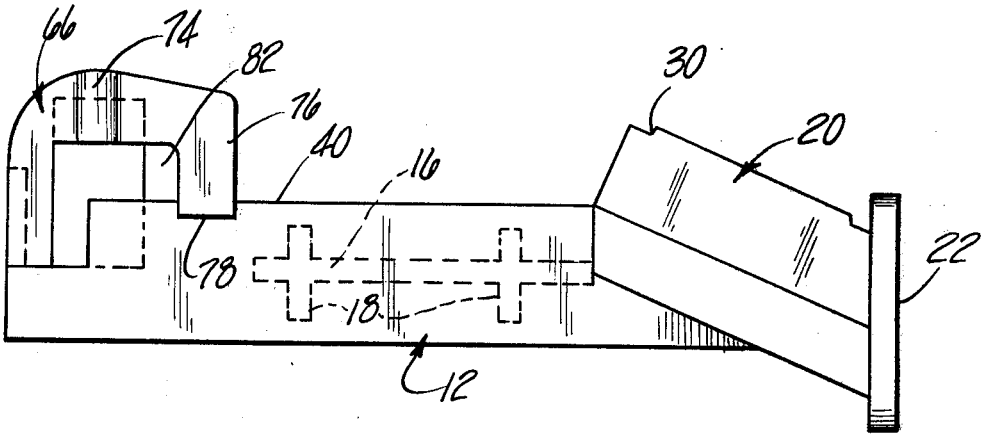
FIG. 6 is a side view of the insulator of FIG. 5.

FIGS. 5 and 6 disclose a second embodiment 64 of this invention wherein the mounting means 20 and elongated body 12 are the same as shown in FIGS. 1 and 2. In this embodiment the abutment means 66 comprises an irregular hexagon-shaped member 68 extending upward perpendicularly from the upper surface 40 of the elongated body 12. A pair of arms 70 extend upward from the body, the upright arms being attached to the body 12 and an extended V-shaped portion 72 of the hexagonal member 68. The upright arms 70 each have a midsection 74 which extends parallel to the elongated body 12 when viewed from the side and at an acute angle to the elongated body when viewed from the top. The midportions of the arms extend outward away from the body creating a space between the arms and the body to allow the introduction of a wire therebetween. A free or terminal portion 76 of each arm 70 depends perpendicularly toward the body from the midsection 74 toward the elongated body 12. The free end 78 terminates below the surface of the body.

In use, an electrical wire to be held by the insulator is inserted along a slot 80 formed between the arm and body and the wire is then moved upward until it lies within the nominally rectangular aperture 82 defined by the abutment means, the midarm, the depending arm and the upper surface of the elongated body. The rounded V-shaped portion 72 of the abuttment means 66 allows tensioning of the already strung wire by pulling on the wire exiting from the insulator. The entire threading operation of the wire can be performed without uncoiling the wire as it is not necessary to thread the wire's free end through the apertures.

It is apparent from the foregoing description that an improved electric insulator for electric fences has been disclosed which allows a wire to have its direction at a corner post and which provides a rigid abutment means suitable for tensioning the wire already in place. Various modifications and alterations of this invention will become apparent to those skilled in the art without departing from the scope and spirit of this invention and it is understood this invention is not limited to the illustrative embodiments set forth herein.

I claim:

1. An electric fence insulator for guiding and supporting electric fence wire upon a fence post, said fence insulator comprising an elongated body of electric insulating material, mounting means at one end of said body for mounting said body in an outwardly projecting position upon a fence post, an abutment member fixed on said body and projecting upwardly from said body at the other end thereof, and wing tabs fixedly mounted at the upper end of said abutment member and projecting from said abutment member generally toward said mounting means in a generally parallel vertically spaced relationship to the upper side of said body, said tabs each having a dependent portion extending perpendicularly to the longitudinal axis of said elongated body, said dependent portions being spaced from said abutment means in a direction toward said mounting means and having their points of termination below the plane defined by the upper surface of said elongated body.

2. The electric fence insulator of claim 1 wherein said mounting means has a surface thereon disposed at an angle to the plane defined by the upper portion of the elongated body said surface being adapted to receive pressure from the head of a nail used to fasten said insulator to a wood post, said surface having a portion thereof removed in the longitudinal direction on the upper exposed surface thereof so that a minor portion of the head of a nail is exposed when the insulator is nailed in position.

3. The electric fence insulator of claim 1 wherein said mounting means has a longitudinal nail receiving portion therethrough, said nail receiving portion having an axis disposed at an acute angle to the longitudinal axis of said elongated body whereby said elongated body has a reduced propensity to rotate about its longitudinal axis when nailed to a post.

4. An electric fence insulator for guiding and supporting an electrified fence wire spaced from a fence post, said insulator comprising an elongated body of electrical insulating material; mounting means located at a first end of said body for mounting said body to a fence post in an outwardly projecting manner; an upright member attached to the body at the end of said body opposite said mounting means. said upright member having a portion which projects outwardly from said body; tab means located on the free end of said upright member, said tab means comprising at least two wing tabs extending from said upright member in a generally parallel relationship to the nearest surface of said elongated body and having axes which are disposed at an acute angle to the longitudinal axis of said body in a direction substantially towards said mounting means; and a step projecting from said upright member, said step having a surface substantially coplanar with said nearest surface and extending in a direction away from said mounting means.

5. The electric fence insulator of claim 4 wherein said upright member has a relatively large retainer tab extending parallel to the longitudinal axis of the elongated body in a direction substantially towards said mounting means.

6. The electric fence insulator of claim 4 wherein said mounting means has a surface thereon disposed at an angle to the plane defined by the upper portion of the elongated body, said surface being adapted to receive pressure from the head of a nail used to fasten said insulator to a wood post, said surface having a portion thereof removed in the longitudinal direction on the upper exposed surface thereof so that a minor portion of the head of a nail is exposed when the insulator is nailed in position.

* * * * *